US008519292B2

(12) United States Patent
Domejean

(10) Patent No.: US 8,519,292 B2
(45) Date of Patent: Aug. 27, 2013

(54) ARC CHUTE AND CIRCUIT BREAKER EQUIPPED WITH ONE SUCH ARC CHUTE

(75) Inventor: Eric Domejean, Voreppe (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 910 days.

(21) Appl. No.: 12/289,830

(22) Filed: Nov. 5, 2008

(65) Prior Publication Data

US 2009/0120908 A1 May 14, 2009

(30) Foreign Application Priority Data

Nov. 13, 2007 (FR) ..... 07 07970

(51) Int. Cl.
*H01H 9/44* (2006.01)

(52) U.S. Cl.
USPC ..... 218/23; 218/34; 218/149; 335/201

(58) Field of Classification Search
USPC ..... 218/15, 22–28, 34–38, 149, 156–158; 335/201
See application file for complete search history.

(56) References Cited

U.S. PATENT DOCUMENTS 7,259,646 B2 * 8/2007 Rab et al. ..... 218/22

FOREIGN PATENT DOCUMENTS

| | | |
|---|---|---|
| DE | 1 185 269 | 1/1965 |
| DE | 27 16 619 | 9/1978 |
| DE | 86 11 282 | 6/1986 |
| EP | 0 138 174 | 4/1985 |
| EP | 0 217 106 | 4/1987 |
| EP | 1 693 869 | 8/2006 |
| FR | 2 622 736 | 5/1989 |
| FR | 2 879 016 | 6/2006 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

An arc chute including an arc extinguishing chamber formed by a stack of deionizing plates, an arc formation chamber defined by first and second side walls or cheeks, and a system for removing gases generated when an electric arc forms in the chute, that include a removal duct behind the second cheek and connected to an exchange space. The arc extinguishing chamber includes permanent magnets, at least a part of the magnets being behind the first cheek, and the gas removal system includes an opening formed partially in the second cheek and exiting outside the arc chute. A circuit breaker may include such an arc chute.

9 Claims, 4 Drawing Sheets

ARC CHUTE AND CIRCUIT BREAKER EQUIPPED WITH ONE SUCH ARC CHUTE

BACKGROUND OF THE INVENTION

The invention concerns the field of breaking devices, in particular devices enabling direct currents to be broken.

The invention relates to an arc chute for a circuit breaker comprising:

- an arc extinguishing chamber formed by a stack of deionizing plates separated from one another by an exchange space,
- an arc formation chamber delineated by a first cheek and a second cheek, and
- gas removal means to remove the gases generated when an electric arc forms, comprising a removal duct arranged behind the second cheek and connected to at least one exchange space.

The invention also relates to a circuit breaker comprising separable contacts and an arc chute to extinguish an electric arc formed when opening of said contacts takes place.

STATE OF THE ART

In breaking devices such as circuit breakers, opening of the contacts generally generates an electric arc which has to be dissipated in an arc chute. The electric arc generally has to be cooled as quickly as possible while remaining away from the electric contacts. This cooling is commonly achieved by placing the arc inside an arc extinguishing chamber formed by a stack of deionizing fins or plates separated from one another by an exchange space and enabling a better exchange to be established.

After it has formed, the electric arc moves in an arc formation chamber delineated by side walls or cheeks before entering the arc extinguishing chamber generally passing via the exchange spaces between the deionizing plates. In practice, the electric arc can be pushed into the arc extinguishing chamber by electrodynamic forces induced by a magnetic field due to the current flowing in the conductors. The exchange spaces between the deionizing plates enhance migration of the arc to the back of the chamber. The stack of deionizing plates further enables the arc to be broken down and facilitates insertion thereof in the arc extinguishing chamber. The arc extinguishing chamber and deionizing plates further contain the electric arc, which tends to dilate to invade all the available space.

Initiation of the electric arc is accompanied by release of a large quantity of metallic vapors, which may, if they are not removed, be responsible in particular for a linking arc between the phases of the electric switchgear device and cause an explosion. Numerous solutions provide for the use of removal means to remove the gases generated when formation of an arc takes place. These solutions can enable removal to be performed from the zone close to the contacts, or even to outside the switchgear device, or again recycling inside the switchgear device itself to comply for example with environmental requirements.

One such solution is known from French Patent application FR2879016 which describes an electric switchgear device comprising an arc extinguishing chamber opening out onto an opening volume, said chamber being delineated by two cheeks and equipped with a stack of deionizing plates separated from one another by exchange spaces. The electric switchgear device described in this Patent application further comprises removal means, in this instance removal ducts, arranged behind the cheeks and connected to the exchange spaces.

This type of solution may present certain drawbacks, such as increasing the volume of the electric switchgear device around the arc chute. The gases are in fact conducted into removal means which congest the arc chute and/or the neighboring spaces.

SUMMARY OF THE INVENTION

The object of the invention is to remedy the shortcomings of arc chutes of the prior art by proposing an arc chute for a circuit breaker comprising:

- an arc extinguishing chamber formed by a stack of deionizing plates separated from one another by an exchange space,
- an arc formation chamber delineated by a first cheek and a second cheek, and
- gas removal means to remove the gases generated when an electric arc forms, comprising a removal duct arranged behind the second cheek and connected to at least one exchange space.

The arc chute according to the invention comprises permanent magnets, at least a part of said magnets being located behind the first cheek, and the gas removal means comprise an opening formed partially in the second cheek and opening out outside the arc chute.

The arc formation chamber preferably comprises:

- an enhanced induction section in which the electric arc is propelled towards the arc extinguishing chamber by the magnetic field generated by a first part of the permanent magnets, and
- a diverting section in which the electric arc is diverted with respect to a longitudinal axis of the arc formation chamber towards the first cheek by the magnetic field generated by a second part of the permanent magnets, the whole of the second part of the permanent magnets being located behind the first cheek.

The first part of the permanent magnets preferably comprises two magnetized fractions arranged behind each of the cheeks.

The two magnetized fractions of the first part of the permanent magnets are preferably arranged symmetrically with respect to a longitudinal axis of the arc formation chamber.

According to one embodiment, the opening is partially formed in a wall of the case.

According to one embodiment, the removal duct extends between at least one exchange space and the opening and presents a substantially constant or decreasing cross section.

According to one embodiment, the deionizing plates comprise a leading edge equipped with a central depression.

According to one embodiment, the first cheek is made of ceramic material. The second cheek is preferably made of gas-generating material.

The invention also relates to a circuit breaker comprising separable contacts and an arc chute to extinguish an electric arc formed when said contacts open, in which the arc chute is as described above.

BRIEF DESCRIPTION OF THE DRAWINGS

Other advantages and features will become more clearly apparent from the following description of particular embodiments of the invention given for non-restrictive example purposes only and represented in the accompanying drawings.

DETAILED DESCRIPTION OF AN EMBODIMENT

As represented in FIGS. 1 to 4, the circuit breaker pole-unit comprises a movable contact 1 and a stationary contact 2, each of these contacts being connected by means of a conductor to a connection terminal of the circuit breaker. Opening of the movable contact can be commanded by an operating mechanism by means of a handle or by tripping means that are not represented. These tripping means can comprise an electromagnetic trip device and a thermal trip device, both able to cause automatic opening of the movable contact in the event of an overload and/or a short-circuit.

Figure 1:
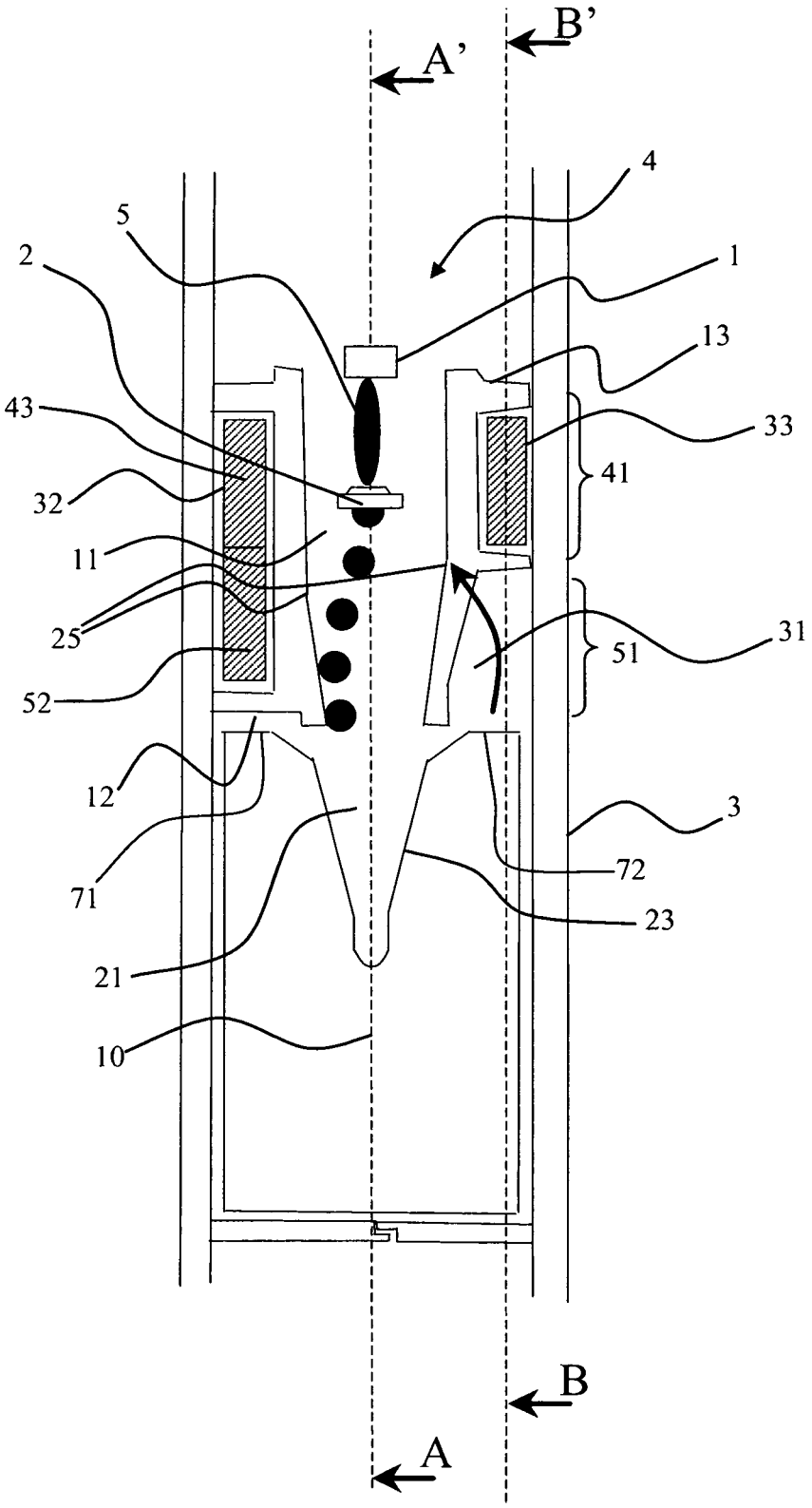
FIG. 1 represents a longitudinal section of an arc chute according to the invention.

The circuit breaker elements, such as the separable contacts, operating mechanism and tripping means, are generally housed in a molded case 3 made from insulating material. As represented in FIG. 1, case 3 also houses an arc chute 4 designed to extinguish the electric arc 5 formed between the separable contacts when the latter open.

Figure 2:
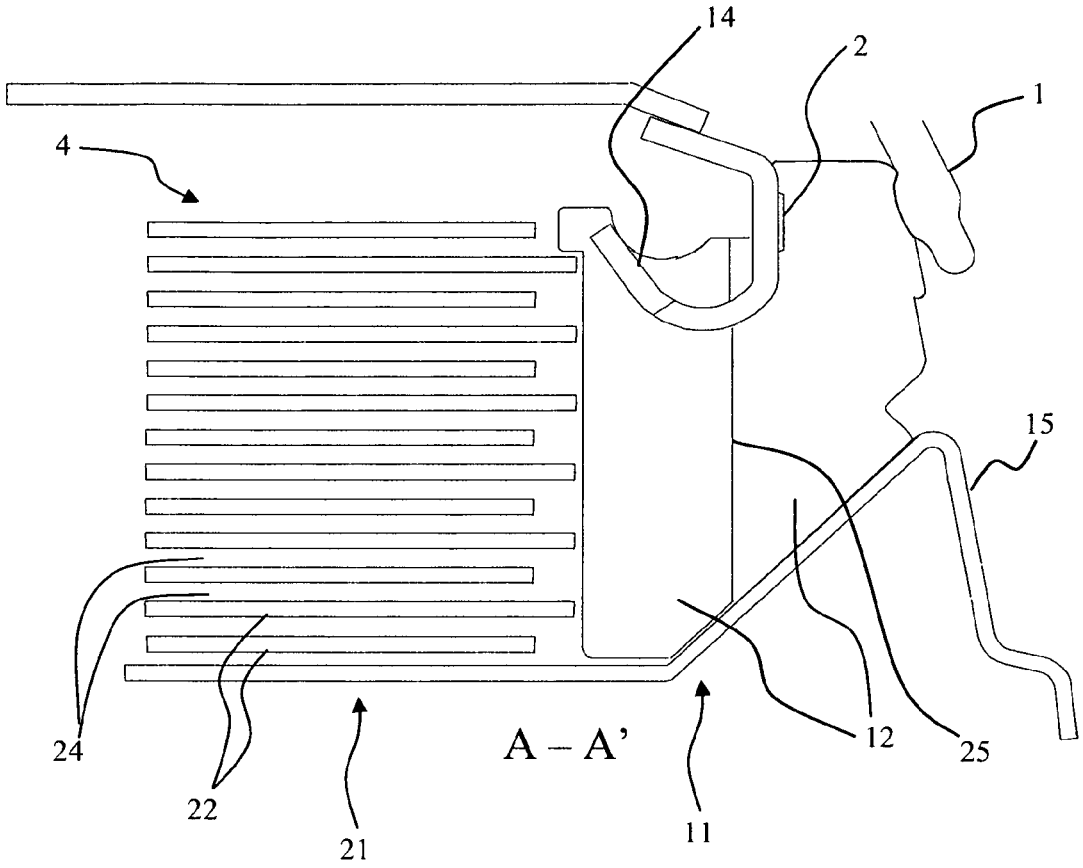
FIG. 2 represents a cross section of this same arc chute along an axis A-A' represented in FIG. 1.

As represented in FIGS. 1 and 2, arc chute 4 comprises an arc formation chamber 11 delineated by a first cheek 12 and a second cheek 13. One of the terminals of the circuit breaker pole-unit is electrically connected to stationary contact 2 and extends to form an electrode or arcing horn 14 that extends in the top part of the arc formation chamber. Another terminal of the circuit breaker pole-unit electrically connected to movable contact 1 is connected to another electrode or arcing horn 15 that extends in the bottom part of the arc formation chamber. The electrodes or arcing horns 14 and 15 are arranged such as to collect an arc drawn between contacts I and 2 when separation of the latter takes place. The electric arc formed between the two contacts is thus collected by the electrodes to be transported and removed to an arc extinguishing chamber 21 of the arc chute.

As represented in FIGS. 1 and 2, arc extinguishing chamber 21 is formed by a stack of deionizing plates 22 that are generally metallic plates. The deionizing plates comprise a leading edge via which the electric arc enters the arc extinguishing chamber. As can be seen in FIG. 1, the leading edge of the deionizing plates generally comprises a central depression 23. Deionizing plates 22 are separated from one another by exchange spaces 24. As can be seen in FIGS. 1 and 2, the faces of cheeks 12 and 13 on the side where the arc formation chamber is located are slightly curved to better guide the electric arc to central depression 23 of the deionizing plates. The faces of cheeks 12 and 13 on the side where the arc formation chamber is located thereby comprise an edge 25 marking a change of incline of said faces near to arc extinguishing chamber 21.

Figure 3:
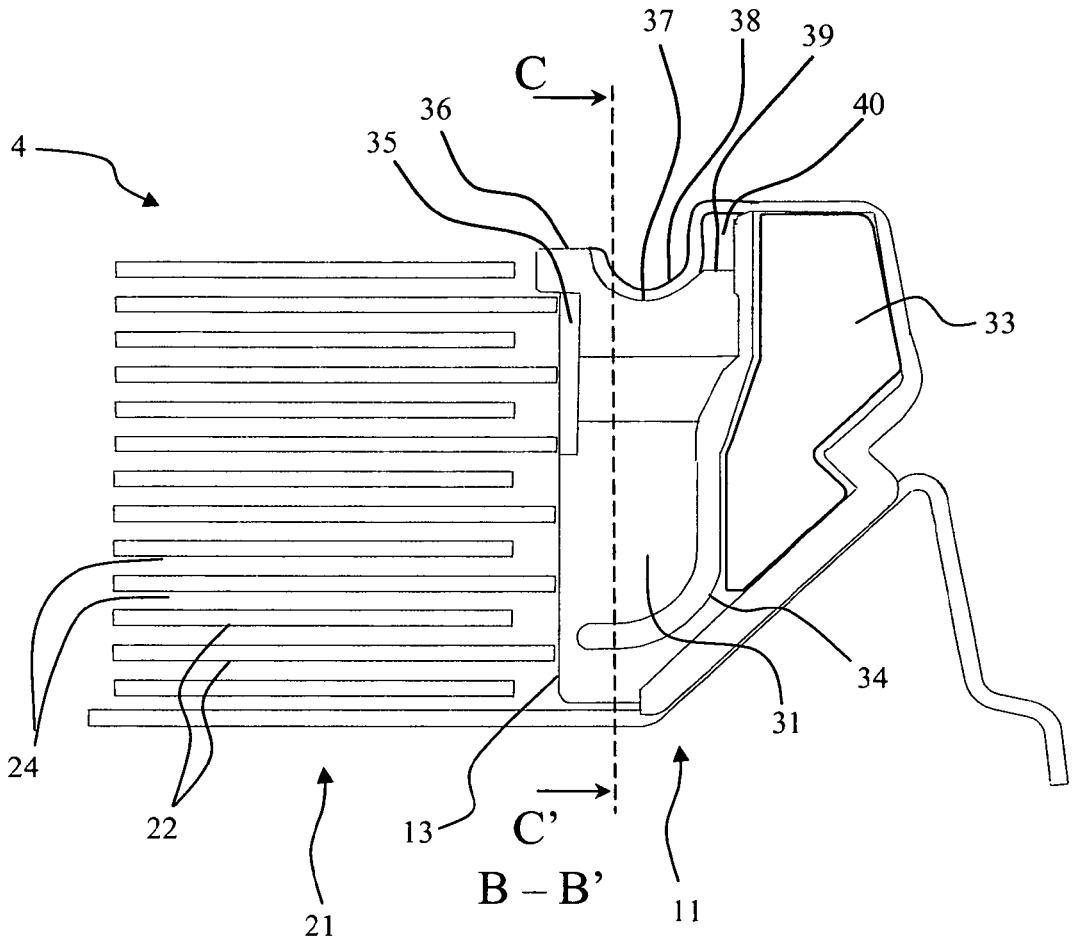
FIG. 3 represents another cross section of this same arc chute along an axis B-B' represented in FIG. 1.
Figure 4:
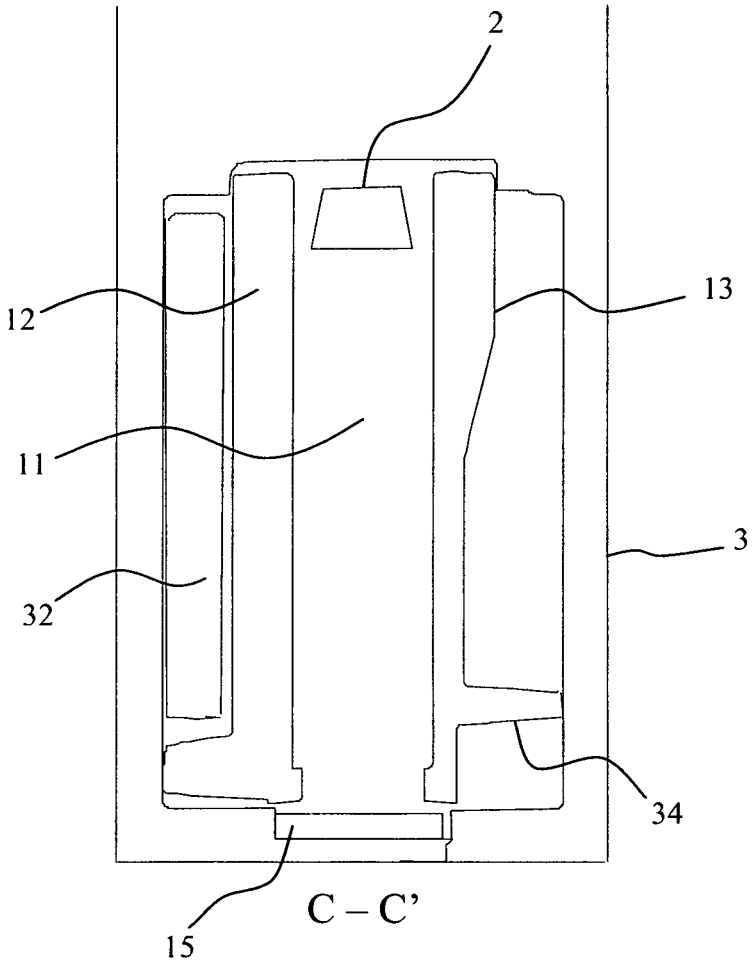
FIG. 4 represents a lateral section of this same arc chute along an axis C-C' represented in FIG. 3.

As can be seen in FIGS. 1, 3 and 4, the arc chute comprises permanent magnets 32, 33, represented in hatched manner in FIG. 1, at least a part 32 whereof are arranged behind first cheek 12. Preferably, most or even all of the permanent magnets are arranged behind first cheek 12. A dissymmetric arrangement is thereby obtained with respect to the longitudinal axis A-A' comprising at least a part, or even most or all, of the permanent magnets on one side, and the removal means on the other side. With such an arrangement, the electric arc is attracted by permanent magnet 32.

As represented in FIGS. 1, 3 and 4, the arc chute comprises gas removal means to remove the gases generated when formation of an electric arc takes place. As can be seen in FIG. 1, these removal means comprise a removal duct-31 arranged behind a part of second cheek 13 and connected to at least one exchange space 24. Due to the dissymmetric arrangement in which only a part, or even none, of the permanent magnets are located behind second cheek 13, a space is available behind this second cheek to house removal means, such as removal duct 31. The removal duct is thus arranged behind this second cheek without increasing the volume of the switchgear apparatus around the arc chute and without modifying the shape of the case. In this way, removal duct 31 does not congest the arc chute and/or the surrounding spaces.

As can be seen in FIGS. 3 and 4, removal duct 31 is mainly formed by the side wall of case 3 and the surface of cheek 13 facing the case. Cheek 13 comprises a wall 34, on its surface facing the case, which wall cooperates with an inside surface of case 3, after the switchgear unit has been assembled. This wall 34 among other things prevents any contact of the exhaust gases with magnet 33. This wall 34 also defines a part of removal duct 31. Cheek 13 comprises a groove 35 on its surface facing the case, which groove is arranged facing the leading edges of the deionizing plates in a top part of the extinguishing chamber. This groove 35 cooperates, after assembly, with the edge of a wall formed in the case. Cheek 13 further comprises a reinforcement 36 the peripheral surfaces whereof cooperate, after assembly, with the edge of a wall formed in the case. The cheek further comprises a curved edge 37 cooperating, after assembly, with an extension 38 of the walls formed in the case. In this way, removal duct 31 is formed by:

- the surface of cheek 13 facing the inside surface of case 3, said inside surface of case 3,
- wall 34 of the cheek cooperating with the inside surface of case 3,
- the walls of the case whose edges cooperate with groove 35, the peripheral surface of reinforcement 36, and
- the extension of said edges cooperating with curved edge 37 of cheek 38.

As can be seen in FIG. 3, an edge 39 at the top end of cheek 13 does not cooperate with the case after assembly. In this way, edge 39 of cheek 13 forms an opening 40, with a part of extension 38 of the wall formed in the case, enabling the exhaust gases to be removed to outside the arc chute. The gases thus recovered in removal duct 31 are therefore removed to the outside of the arc chute by means of opening 40 formed partially in the second cheek and partially by extension 38 of the wall arranged on the inside surface of the case.

As represented in FIG. 1, the arc formation chamber comprises an enhanced induction section 41 in which the electric arc is propelled to arc extinguishing chamber 21 by the magnetic field generated by a first part of the permanent magnets. The magnetic field generated by a first part of the permanent magnets in the enhanced induction section is greater than that generated by the other part of the permanent magnets in the rest of the arc formation chamber. This enables the electric arc to be better propelled and to make the latter leave the separable contacts. Switching of the root of the electric arc between movable contact 1 and electrode 15 is therefore mainly obtained by means of the first part of the permanent magnets in the enhanced induction section of the arc formation chamber. In the case of breaking of a direct electric current of weak intensity, the magnetic induction created by flow of the current in electrodes 14 and 15 is no longer sufficient to remove the electric arc to arc extinguishing chamber 21. This arrangement of the permanent magnets thereby enables the magnetic field to be increased to remove the electric arc.

As represented in FIG. 1, the first part of the permanent magnets comprises two magnetized fractions arranged behind each of the cheeks. These two magnetized fractions are essentially formed by magnet 33 and a part 43 of magnet 32 housed in enhanced induction section 41. These two magnetized fractions 33 and 43 of the first part of the permanent magnets are arranged symmetrically with respect to a longitudinal axis A-A' 10 of the arc formation chamber. This enables the properties described above to be further improved, i.e. it enables the electric arc to be propelled more efficiently to the arc extinguishing chamber.

As represented in FIG. 1, the arc formation chamber further comprises a diverting section 51 in which the electric arc is diverted with respect to the longitudinal axis 10 of the arc formation chamber towards first cheek 12. This arc is diverted by the magnetic field generated by a second part of the permanent magnets, i.e. a magnetized 52 fraction of permanent magnet 32. The different positions of this electric arc are represented in FIG. 1 by points 26. With such an arrangement, the magnetic field generated by the second part of the permanent magnets on the longitudinal axis A-A' is weaker than that generated by the first part of the permanent magnets. Furthermore, the magnetic field generated by the second part of the permanent magnets is not symmetrical with respect to said longitudinal axis. This assists in diverting the electric arc from its trajectory. The diverting component of the electric arc is therefore mainly obtained by means of the second part of the permanent magnets in diverting section 51.

In the embodiment represented in FIGS. 1 to 4, the whole of the second part of the permanent magnets, i.e. magnetized fraction 52, is arranged behind first cheek 12. As described before, this arrangement enables an available space to be had for housing removal duct 31 behind second cheek 13, in diverting section 51. The dissymmetric arrangement of the permanent magnets with respect to the axis A-A' combined with housing the removal means behind one of the cheeks enables an optimized arc chute to be obtained with a better dissipation of the electric arc in terms of heat transfer and transfer of material.

In the embodiment represented in FIGS. 1 and 2, removal duct 31 extends between at least one exchange space 24 and opening 40 and presents a cross section that is substantially decreasing in the gas flow direction. This enables the gas to be speeded up on outlet and amplifies the gas cooling effect in a zone close to the contacts. In this way, the time between the moment the arc leaves the contacts and the moment it reaches the leading edge of the deionizing plates is reduced.

As can be seen in FIG. 1, the leading edge of the deionizing plates is equipped with a central depression 23 and with two lateral parts 71 and 72 facing in the direction of diverting section 51 of arc formation chamber 11. The electric arc is directed in the diverting section towards lateral part 71. In the case of breaking a direct current of strong intensity or an alternating current, it is generally sought to make the arc enter the extinguishing chamber via the central depression. This enables the electric arc to be deionized in the middle of the extinguishing chamber to dissipate a maximum amount of energy. In the case of breaking a weak intensity current, it is rather sought to make the electric arc enter the extinguishing chamber as quickly as possible to prevent it from remaining and dissipating energy within the arc formation chamber, i.e. upstream from the arc extinguishing chamber. In the case of breaking a weak intensity current, the electric arc can extend over lateral part 71 of the leading edge of extinguishing chamber 21 due to the small amount of energy to be dissipated.

Cheeks 12 and 13 delineating the arc formation chamber are generally formed from an electrically insulating material. To obtain a good electrical endurance with direct currents of weak intensity, with relatively long clearing times compared with alternating currents, the cheeks can be formed from an electrically insulating material that does not erode easily, such as ceramic, for example alumina or cordierite. To obtain good breaking with direct or alternating currents of strong intensity, the cheeks can be formed from a gas-generating electrically insulating material, for example gas-generating nylon. Advantageously, first cheek 12 is made from ceramic material and second cheek 13 is a gas-generating organic material. The gas-generating cheek enables the pressure in the contact zone to be increased thus fostering departure of the electric arc from the contact zone to the extinguishing chamber.

The invention also extends to an arc chute comprising three permanent magnets, a first and second magnet being arranged behind the first cheek respectively in the enhanced induction section and in the diverting section, and a third magnet being arranged behind the second cheek in the enhanced induction section.

One advantage of the arc chute according to the invention is that it enables a better circulation of the gases generated when formation of the arc takes place. The dissymmetric arrangement of the permanent magnets with respect to the axis A-A' does in fact mean that the electric arc is diverted onto first cheek 12 behind which most of the permanent magnets are arranged. At the same time, the gases generated when formation of the arc takes place will be transported in this same direction, i.e. to first cheek 12, before entering extinguishing chamber 21 on the same side as the first cheek. The gas will then expand in the remaining space of the extinguishing chamber, i.e. essentially in the direction of the opposite side of the extinguishing chamber, i.e. on the same side as second cheek 13 behind which the removal duct is arranged. Expansion of the gas will continue in the direction of the communicating evacuation holes between the exchange spaces and the removal duct, thus enhancing the gas flow in the removal means. This arrangement prevents a gas lock from forming between the electric arc and the deionizing plates. If this gas lock is too great, it then limits displacement of the electric arc and may even prevent insertion thereof in the deionizing plates.

The invention claimed is:

1. An arc chute for a circuit breaker comprising:

an arc extinguishing chamber formed by a stack of deionizing plates separated from one another by an exchange space;

an arc formation chamber defined by first and second cheeks which are substantially symmetrical vis-á-vis a longitudinal axis of the chute; and means for removing gases generated when an electric arc forms in the chute, comprising a removal duct behind the second cheek and connected to at least one exchange space, wherein the arc extinguishing chamber comprises permanent magnets, at least a part of said magnets being located behind the first cheek, and the means for removing gases comprise an opening in the second cheek and exiting outside the arc chute; and the arc formation chamber comprises:

an enhanced induction section wherein an electric arc can be propelled towards the arc extinguishing chamber by a magnetic field generated by a first part of the permanent magnets; and a diverting section in which an electric arc may be diverted with respect to a longitudinal axis of the arc formation chamber towards the first cheek by a magnetic field generated by a second part of the permanent magnets, the whole of the second part of the permanent magnets being located on only one side of the longitudinal axis of the arc formation chamber and only behind the first cheek, and the second part comprising only one magnetized fraction.

2. The arc chute according to claim 1, wherein the first part of the permanent magnets comprises two magnetized fractions located behind each of the first and second cheeks.

3. The arc chute according to claim 2, wherein the two magnetized fractions of the first part of the permanent magnets are arranged symmetrically with respect to a longitudinal axis of the arc formation chamber.

4. The arc chute according to claim 1, in a case, and wherein the exiting opening is in the wall of the case.

5. The arc chute according to claim 1, wherein the removal duct extends between at least one exchange space and the opening, and presents a substantially constant or decreasing cross section.

6. The arc chute according to claim 1, wherein the deionizing plates comprise a leading edge having a central depression therein.

7. The arc chute according to claim 1, wherein the first cheek is ceramic material.

8. The arc chute according to claim 7, wherein the second cheek is a gas-generating organic material.

9. A circuit breaker comprising separable contacts and an arc chute according to claim 1 for extinguishing an electric arc formed when opening of said contacts takes place.

* * * * *